US005239974A

United States Patent [19]

Ebinger et al.

[11] Patent Number: 5,239,974

[45] Date of Patent: Aug. 31, 1993

[54] ELECTRONIC SYSTEM FOR CONTROLLING THE FUEL INJECTION OF AN INTERNAL-COMBUSTION ENGINE

[75] Inventors: Bernhard Ebinger, Korntal-Münchingen; Peter-Juergen Schmidt, Schwieberdingen; Nikolaus Benninger, Vaihingen/Enz; Lutz Reuschenbach, Stuttgart; Eberhard Schnaibel, Hemmingen, all of Fed. Rep. of Germany

[73] Assignee: Robert Bosch GmbH, Stuttgart, Fed. Rep. of Germany

[21] Appl. No.: 880,049

[22] Filed: May 7, 1992

[30] Foreign Application Priority Data

May 10, 1991 [DE] Fed. Rep. of Germany ..... 4115211

[51] Int. Cl.[5] ..... F02D 41/10; F02D 41/12; F02D 41/14

[52] U.S. Cl. ..... 123/675; 123/492; 123/493

[58] Field of Search ..... 123/478, 480, 492, 493, 123/682, 698, 675, 674

[56] References Cited

U.S. PATENT DOCUMENTS

| | | | |
|---|---|---|---|
| 4,440,136 | 4/1984 | Denz et al. | 123/491 |
| 4,852,530 | 8/1989 | Nagaishi | 123/492 |
| 4,901,240 | 2/1990 | Schmidt et al. | 364/431.06 |
| 4,922,877 | 5/1990 | Nagaishi | 123/493 X |
| 5,031,597 | 7/1991 | Monden | 123/492 |
| 5,127,383 | 7/1992 | Wild | 123/492 |
| 5,127,838 | 7/1992 | Wild | 123/402 |
| 5,134,981 | 8/1992 | Takahashi et al. | 123/492 X |
| 5,134,983 | 8/1992 | Kusunoki et al. | 123/492 |

FOREIGN PATENT DOCUMENTS

| | | |
|---|---|---|
| 3939548 | 6/1991 | Fed. Rep. of Germany . |
| 4040637 | 6/1992 | Fed. Rep. of Germany . |

*Primary Examiner*—Tony M. Argenbright
*Attorney, Agent, or Firm*—Kenyon & Kenyon

[57] ABSTRACT

An electronic system for controlling the fuel injection of an internal-combustion engine based on the load, rotational speed, and temperature, as well as at least an oxygen probe reading in the exhaust pipe. The system determines basic injection-quantity signal as well as a transition-compensation signal to adapt the injection fuel quantity in situations of acceleration and deceleration. The system stores an engine characteristics map for a wall-film-quantity signal, and dividing factors for acceleration and deceleration. The system generates a correction value (Wkor) for the wall-film quantity signal and correction factors (FWS1kor, FWS2kor) for the two dividing factors. Three methods are provided for changing the correction factors in connection with the adaptation and these are based on a direct calculation, based on an estimation of the missing quantity and incremental calculation, and based on an incremental adjustment based on the evaluation of the oxygen-probe voltage.

6 Claims, 7 Drawing Sheets

ELECTRONIC SYSTEM FOR CONTROLLING THE FUEL INJECTION OF AN INTERNAL-COMBUSTION ENGINE

TECHNICAL FIELD

The present invention relates to electronic systems and methods for controlling the fuel injection for internal-combustion engines that have sensors for load, rotational speed, and temperature, as well as an oxygen probe in the exhaust pipe. More specifically, the present invention relates to electronic systems and methods for controlling fuel injection during acceleration and deceleration.

BACKGROUND OF THE INVENTION

German Patent Application No. 39 39 548.0 discloses a fuel injection system for internal combustion engines that works with a wall-film model. In addition to a basic injection signal, a wall-film signal is generated that is dependent on operating parameters. Moreover, a control-factor signal is generated, which given a transient operation of the internal-combustion engine, takes into account the change in the wall film over time.

Another known system is described in German Patent Application No. 40 40 637. This system stores in memory the wall-film quantity as well as a control-factor signal. These stored values can be adapted to the modified operating conditions of the internal combustion engine during the lifetime of a motor vehicle.

The prior art describes a number of measures for transition compensation, in particular for acceleration enrichment, with which one attempts to control this transition condition more precisely and effectively. An example of this is German Patent Application No. 30 42 246, which corresponds to U.S. Pat. No. 4,440,136. Other prior art relating to transition compensation are German Patent Application No. 36 03 137, World Patent Application No. WO 90/064 28, German Patent Application No. 36 36 810, which corresponds to the U.S. Pat. No. 4,852538, and German Patent Application No. 40 06 301.

Prior art that provides a fundamental understanding of the wall-film model is SAE paper 81 04 94 "Transient A/F Control Characteristics of the Five Liter Central Fuel Injection Engine," by C. F. Aquino.

The present invention provides an improved method for controlling fuel injection during acceleration and deceleration.

SUMMARY OF THE INVENTION

The present invention is an electronic system and method for controlling the fuel injection of an internal-combustion engine in which optimal transitional performance is achieved with respect to exhaust gas in a transient operations such as acceleration and deceleration. The present invention also provides a fuel injection control system in which optimal transitional performance is achieved with regard to long-term changes in the performance of the internal-combustion engine or of the individual components.

The system of the present invention enables the long-term changes in the fuel injection system or the engine components to be considered with the result that transient operational conditions, acceleration or deceleration, can also be reliably controlled over a relatively long period of time. Consequently, strict exhaust regulations can be adhered to exactly for the entire lifetime of the motor vehicle.

The improved system and method of the present invention will be described fully in the remainder of the specification with reference to the attached drawings.

DETAILED DESCRIPTION OF THE DRAWINGS

Figure 1:
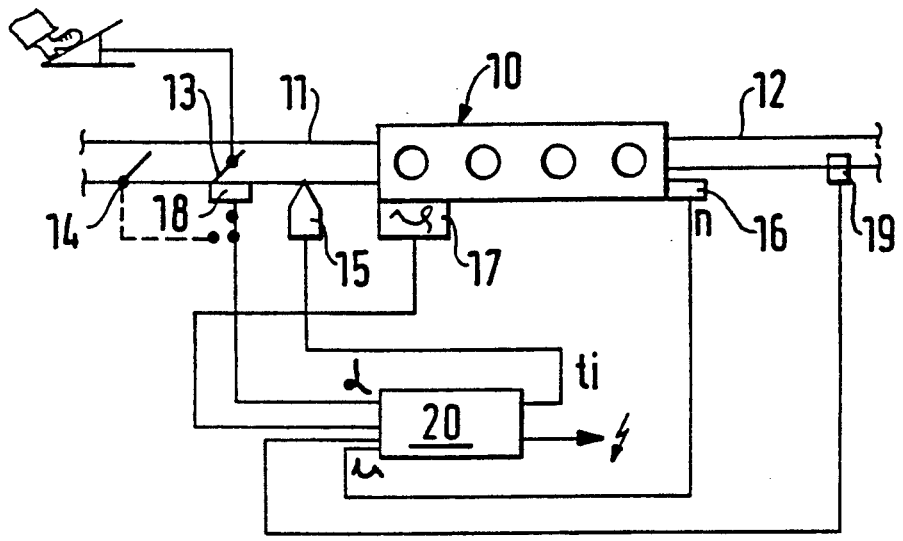
FIG. 1 shows a block diagram of an electronic system for controlling the fuel injection of an internal-combustion engine that incorporates the control system of the present invention.

FIG. 1 shows a block diagram of portions of internal-combustion engine 10 with the engine's most important sensors, a control unit, and an injection valve shown. The engine has air-intake pipe 11 and exhaust pipe 12. Air-intake pipe 11 contains throttle valve 13, and optionally air-flow-rate meter or an air-mass flowmeter 14, or some other system for detecting engine load. The air-intake pipe also has injection valve 15 for injecting the necessary fuel quantity into the air current flowing into the internal-combustion engine 10 through air-intake pipe 11. Engine 10 also has engine-speed sensor 16 and temperature sensor 17 associated with it.

A load signal from throttle-valve sensor 13 and/or from air-flow-rate sensor or air-mass-flow sensor 14 or suction-pipe-pressure sensor 18, together with a signal from an oxygen probe 19 in the exhaust pipe 12, as well as signals from other sensors, are input to control unit 20. Control unit 20 generates a trigger signal for the minimum of one injection valve 15, possibly a firing signal, as well as other trigger signals that are essential to the control of the internal-combustion engine.

The basic structure of a fuel injection system for an internal combustion engine depicted in FIG. 1 is generally known. The present invention is directed to generating a transition-compensation signal for an acceleration or a deceleration condition, with the goal of attaining the most optimal transitional performance possible for the internal-combustion engine or of the motor vehicle equipped with it and, at the same time, with the cleanest possible exhaust.

Figure 2:
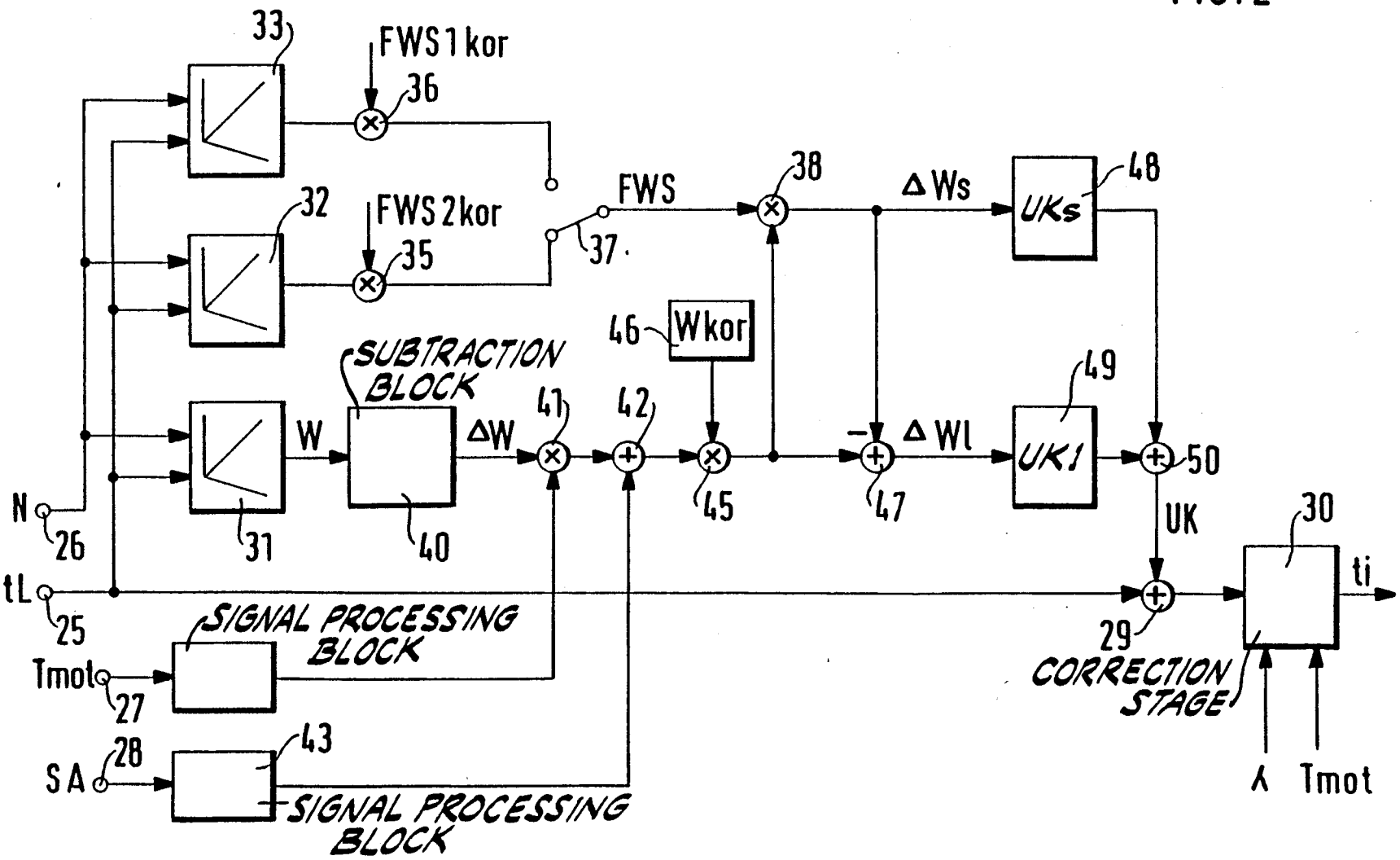
FIG. 2 shows a block diagram of the control system of the present invention that generates a fuel injection signal that depends upon the various operating parameters of the internal-combustion engine and has an element for transition compensation.

A block representation of the signal processing portion of control unit 20 of FIG. 1 is shown in FIG. 2.

Referring to FIG. 2, load signal tL, which corresponds, for example, to the rate of air flow in the suction pipe per stroke, is applied to a terminal 25. Signals with respect to rotational speed and engine temperature, as well as information relating to deceleration (SA) are applied to other connecting terminals 26 through 28, respectively. In addition to the load signal tL from connecting terminal 25, a transition-compensation signal UK is fed to summing point 29. The composite signal at the output of summing point 29 then is input to correction means 30, in which, in the end, injection signal ti is output therefrom, and input to injection valve 15. The signal ti is additionally corrected by lambda (λ) and, among other things, the engine temperature signal Tmot.

A wall-film-quantity characteristic, included by 31, is connected on the input side to terminals 25 and 26 for input thereto of the load signal and rotational speed signal. The output of 31 is the wall-film-quantity signal W. The same input signals, the load signal and rotational speed signal, are also input to engine characteristics maps 32 and 33 to provide load- and speed- dependent controlling factors depending on acceleration or deceleration. As per the arrangement, engine characteristics map 32 contains the corresponding factor for deceleration, and the engine characteristics map 33 contains the corresponding factor for acceleration.

Multiplying stages 35 and 36 are associated with characteristics maps 32 and 33, respectively. The FWS2kor and FWS1kor signals are fed to multiplying stages 35 and 36, respectively. On the output side, the multiplying stages 35 and 36 are connected to changeover switch 37, whose position is dependent upon whether a deceleration or an acceleration condition exists. On the output side, switch 37 is connected to a multiplying stage 38.

Subtraction block 40 is connected to the output of wall-film-quantity characteristic block 31. Subtraction block 40 determines the difference between successive wall-film values which is generated according to the expression $\Delta W = Wk - Wk - 1$. This difference follows the wall-film-quantity characteristic 31 on the output side. The difference quantity ΔW is corrected using a temperature-dependent factor that is based on the Tmot signal at input terminal 27 of multiplication block 41.

Multiplication block 41 is followed by summing point 42, into which the output of signal-processing block 43 is fed. The signal output for signal-processing block 43 is based on the SA signal input to terminal 28 which depends on the occurrence of deceleration.

Multiplication correction stage 45 follows and receives t he output of summing point 42. The Wkor signal from block 46 is a correction signal that is input to multiplication correction stage 45. The output signal from multiplication correction stage 45 is input to multiplication stage 38 and, furthermore, subtraction stage 47. The other input signal for subtraction stage 47 is the signal output from multiplication stage 38. The output signal from multiplication stage 38 is the quantity signal ΔWs, which represents the fast component of the wall-film compensation, and the output signal from subtraction stage 47 is the quantity signal Δ W1 which represents the slow component of the wall-film-quantity compensation. The signals ΔWs and ΔW1 are respectively input to blocks 48 and 49. Blocks 48 and 49 will be discussed in greater detail in FIG. 3. The output signals from two blocks 48 and 49 are combined at summing point 50, whose output signal constitutes the compensation signal UK which is input to summing point 29.

The mode of operation of the overall view roughly sketched in FIG. 2 can be characterized by the following.

In the steady-state operating state of the internal-combustion engine, the basic injection signal or load signal tL at input terminal 25, generated from the air flow rate in the suction pipe and the rotational speed, is corrected in correction stage 30 by at least the engine temperature Tmot and lambda (λ) and, in the end, the corrected signal ti is fed to the injection valve 15.

In the case of a dynamic transition, that is in case of an acceleration or a deceleration, values from the wall-film-quantity characteristic 31 are used to correct the injection signal. The signals representative of wall-film-quantity correspond to the wall film prevailing at any one time for a specific load, as well as for a specific rotational speed n.

On the basis of changes in load and rotational speed, various successive wall-film quantities result. These are determined in block 40. The wall-film difference quantity Δ W is subsequently corrected based on temperature and is influenced depending on whether deceleration exists or not. A further correction follows in the multiplying stage 45 by means of a correction value Wkor which shall be explained in greater detail subsequently.

The two engine characteristics maps 32 and 33 contain dividing factors (FWS1, FWS2) for acceleration and deceleration, respectively. These factors are each corrected subsequently using special correction values FWS2kor and FWS1kor, respectively. The outputs of multiplying stages 35 and 36 are available to multiplying stage 38 via the changeover switch 37 depending on the direction of the load change, that is acceleration or deceleration. In multiplying stage 38, the fast component Δ Ws of the entire extra quantity Δ W is determined. The slow component Δ W1 of the entire extra quantity ΔW is obtained then through subtraction in subtraction stage 47. Subsequent blocks 48 and 49 provide varying regulation of the components Δ Ws and Δ W1 of the extra quantity and in the end, by way of summing point 50, influence the basic injection signal at connecting terminal 25, as transition-compensation signal UK at summing point 29.

Figure 3:
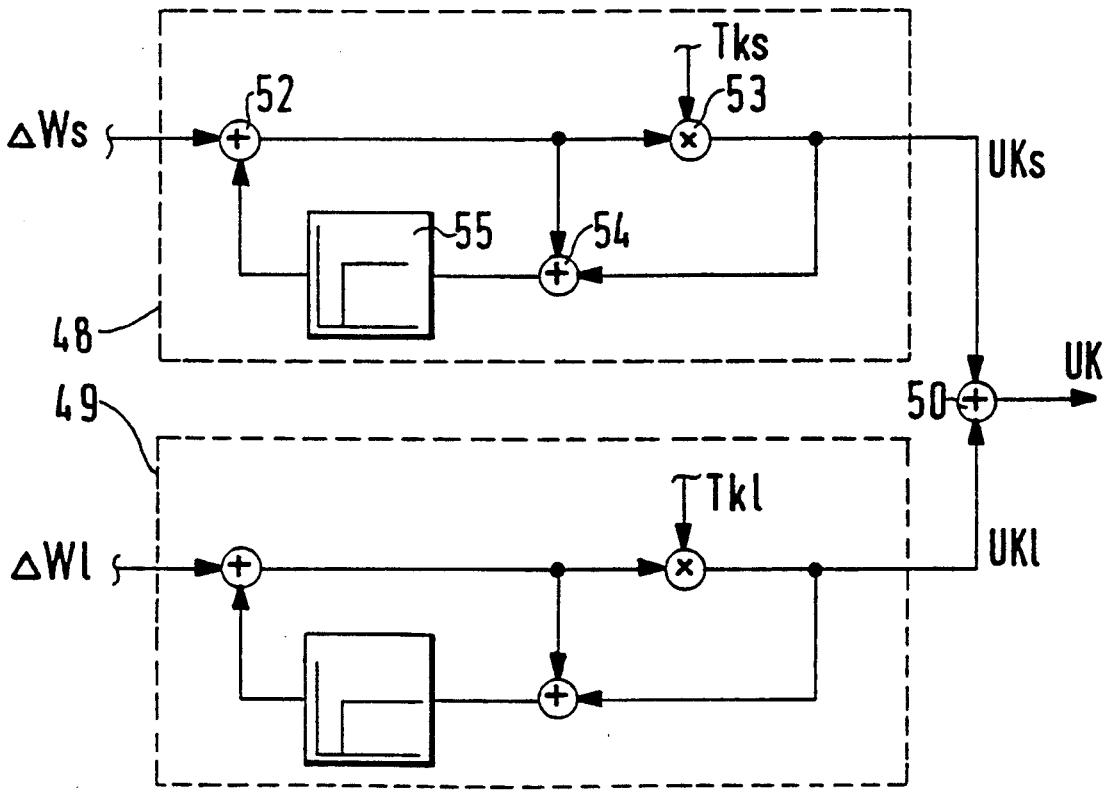
FIG. 3 shows elements 48 and 49 of FIG. 2 in detail which are used for regulating the extra fuel quantity during a transition.

Details about the blocks 48 and 49 are provided in FIG. 3. Referring to FIG. 3, the same elements and the same signals of the two blocks are marked with the same reference numbers or symbols. Blocks 48 and 49 are configured in accordance with the present invention. The output signals from summing point 52 and multiplication stage 53 are fed to summing point 54. The output of summing point 54 is input to lag element 55. The output of lag element 55 is the second input to summing point 52. Finally, fixed regulation factor Tks is fed to multiplication stage 53, or a corresponding regulation factor Tk1 is fed to block 49 depending on whether the fast or slow situation is at hand. The output signal from the multiplication stage 53 generates the signal UKs, which together with the corresponding signal UK1 from block 49, supplies the transition-compensation signal UK.

In terms of function, adding the fast extra quantity Δ Ws to the remainder of the not yet ejected extra quantity is determined in summing point 52 from the preceding computational steps. The actual fast extra quantity UKs to be ejected is determined in the subsequent multiplication stage 53 by multiplying by the factor Tks. By subtracting the actual ejected quantity from the sum of the extra quantities not yet ejected in the summing point 54, one obtains a value for the remaining quantity still be ejected from the next computational steps, whereby this value is stored in the lag element 55. This applies correspondingly for the slow component of the transition compensation in block 49.

At this point, learning processes that are running are important in connection with the present invention for the values Wkor (block 46 of FIG. 2) and the correction factors FWS1kor and FWS2kor for the division.

The non-adaptive transition compensation runs continuously, while the learning operation is initiated only in the case of fast load changes. Only monotonic load changes (rising or falling tL signal) are suited thereby, since otherwise it cannot be decided whether the correction factor FWS1kor for rising load or FWS2kor for falling load must be adapted.

Figure 4:
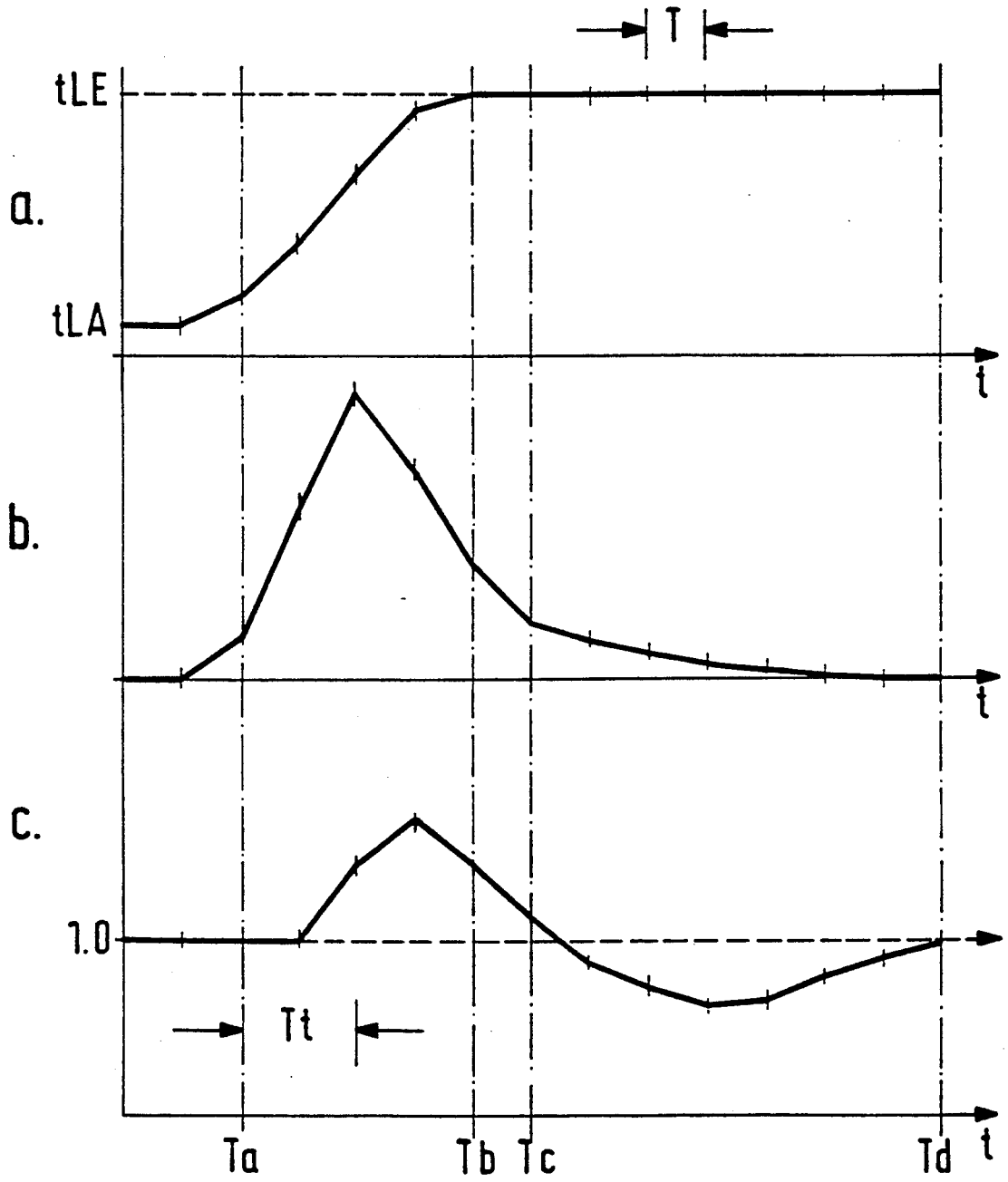
FIG. 4(*a–c*) shows three signal patterns with respect to load change, extra quantity, and lambda (λ), in connection with a linearized probe signal.

FIG. 4 shows the typical time characteristics for load a), correction quantity UK b), and lambda (λ) c) during a learning operation. The beginning of a load change is recognized at an instant t=Ta. At the instant t=Tb, the engine again goes over to steady-state operation. Because of the idle time associated with injection, combustion and exhaust-gas operation time, the lambda (λ) probe reacts only after the idle time Tt. During the time span Ta≦t≦Tc, the lambda (λ) profile is essentially determined by the component of the fast memory. Both extra-quantity memories are regulated at the instant t=Td.

A load change suited for adaptation exists then when the following conditions are fulfilled:

Before the beginning of the load change, the engine must be operating in a steady-state condition for a minimum time T with a constant load and rotational speed.

The extra quantity, which is added after termination of the deceleration and has been made available in block 43 of FIG. 2, must be regulated.

The load changes during the transition must all have the same operational sign (tL rising monotonically or falling monotonically).

The entire load change Δ tL=tLE−tLA (see FIG. 4*a*) must be greater than a threshold value Δ tLmin.

The transition operation must not take longer than a specified maximum time: Tb−Ta≦TUmax.

After termination of the transition, the engine must remain in steady-state operation until the extra-quantity memories are regulated.

During regular operations, the average manipulated variable of the lambda (λ) controller, which has an effect in correction block 30 of FIG. 2, is calculated in the immediate past by means of a sliding mean-value generator or through a low-pass filter. In order for the lambda (λ) profile not to be corrupted during the learning operation by interventions of the lambda (λ) controller, the lambda (λ) controller can be switched off at the instant Ta. The manipulated variable of the lambda (λ) controller is set to the calculated mean value.

The lambda (λ) controller must be switched on again immediately the instant Td is reached according to FIG. 4, or else one of the above-mentioned conditions for adaptation will be violated.

There are various ways of determining the quantity-correction factor Wkor, which is an input variable for the multiplication correction stage 45 of FIG. 2, as well as for adapting the factors FWS1kor and FWS2kor. These shall be dealt with in the following.

1. Direct calculation of the quantity correction factor Wkor is in accordance with the flow diagram in FIG. 5.
2. Estimation of the missing quantity and incremental calculation of Wkor is in accordance with FIG. 6.
3. Incremental adjustment of the correction factors on the basis of the evaluation of the oxygen-probe voltage is in accordance with FIG. 7.

Figure 5:
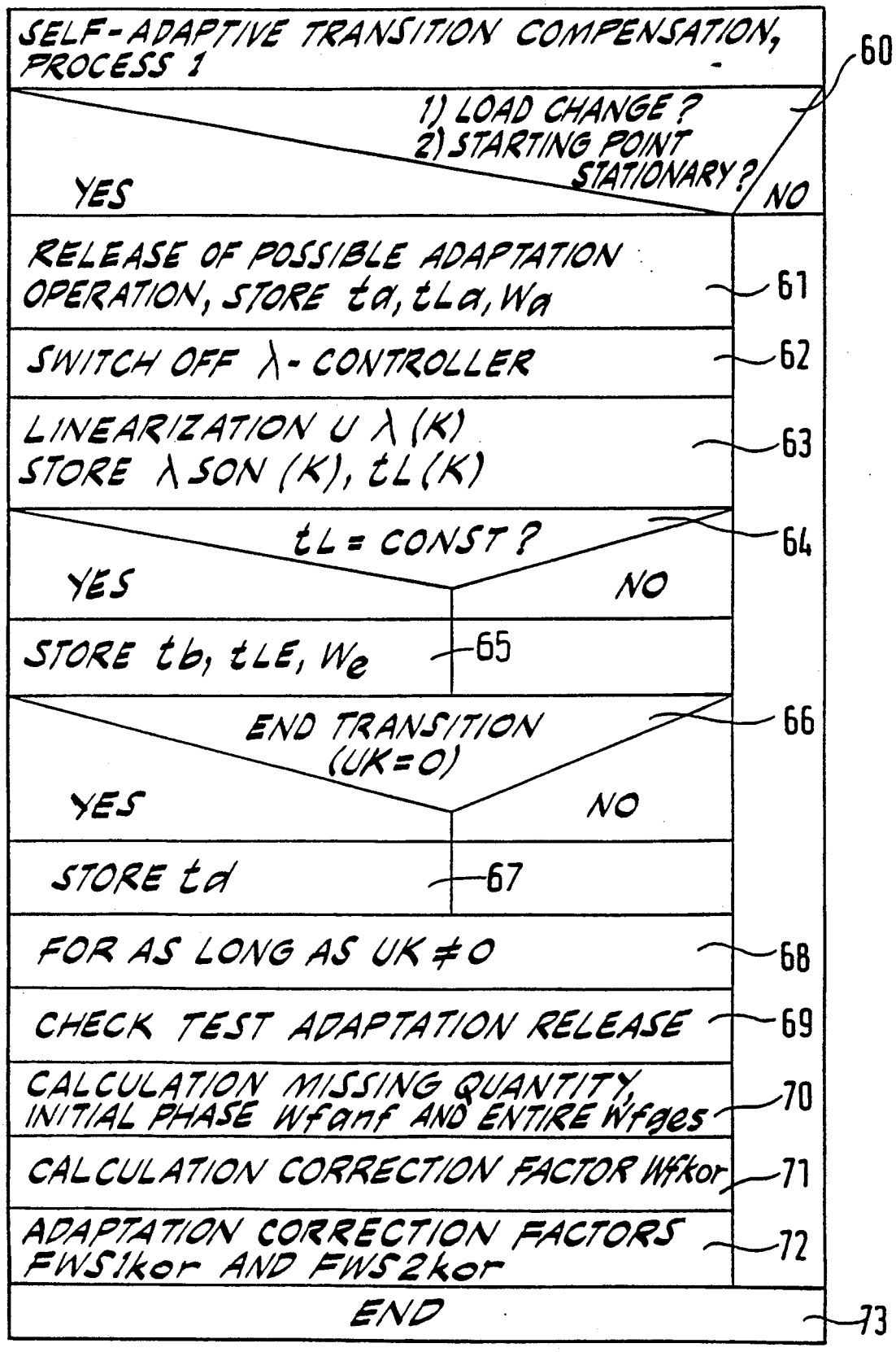
FIGS. 5 and 6 show flow diagrams for realizing self-adaptive transition compensation based on a linearized lambda (λ) probe signal.
Figure 6:
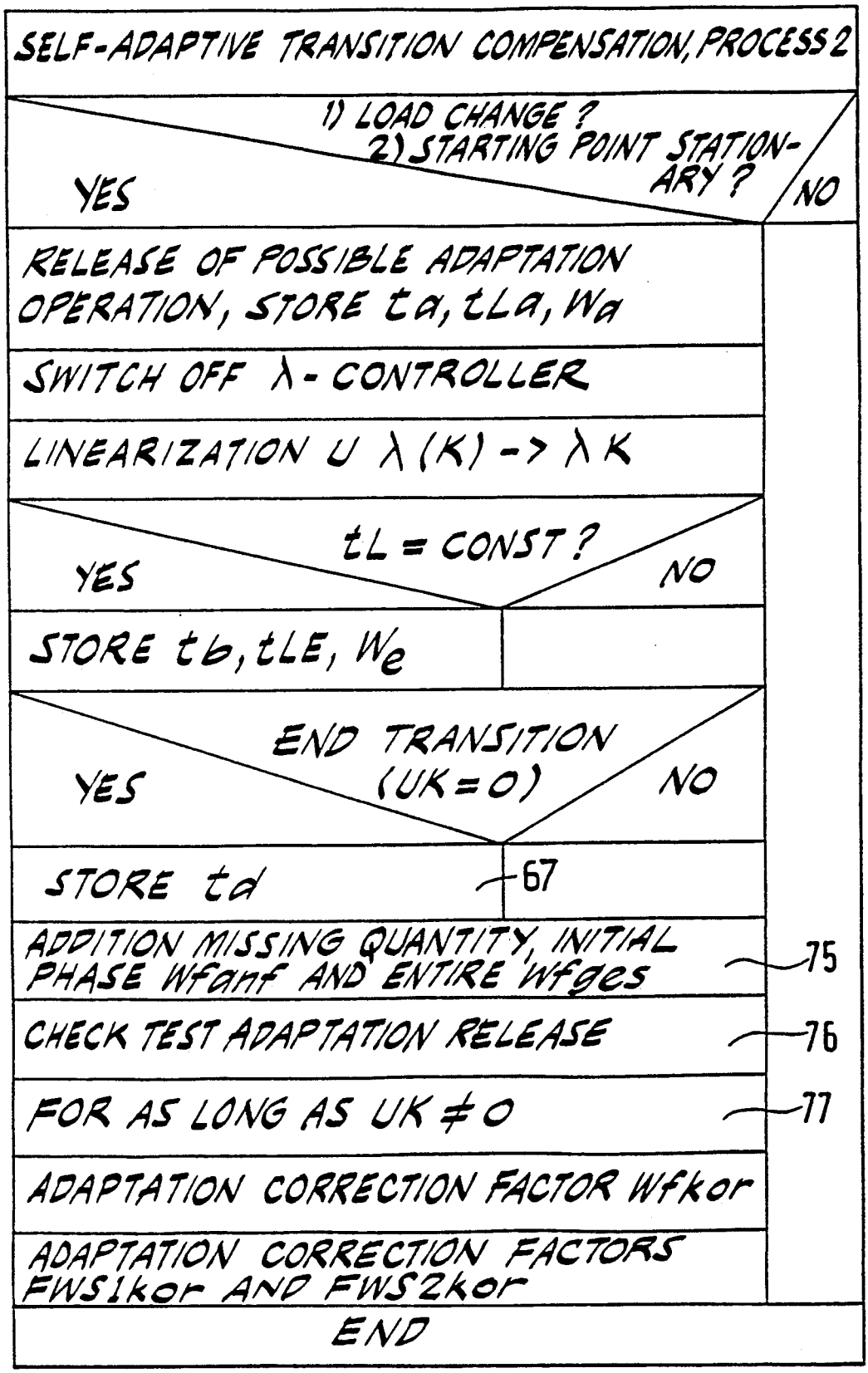

A large section of the beginning area is common for the processes of FIGS. 5 and 6.

According to FIG. 5, a query 60 establishes if a load change exists and if the starting point has been stationary. If this is the case, in 61, a possible adaptation operation is initiated along with the storing of various initial values. The switching-off of the lambda (λ) controller follows possibly in 62. In 63, the output signal from the lambda (λ) probe is linearized at the scanning points K and the specific values are stored. If the load signal tL in the following block 64 proves to be constant, then the values Tb, TLe, We (wall-film quantity end transition, output block 31) are stored, and the end of the transition is waited for in 66. If this end is reached, a storage operation follows again in block 67 and the entire operation continues for as long as the transition compensation is UK≠0 (block 68). As a result, a check test of the adaptation release takes place in block 69. This is followed by the calculation of the missing quantity in 70. The calculation of the correction factor Wkor follows in 71, as well as an adaptation of the correction factors FWS1kor and FWS2kor in 72, before the end is reached in 73.

With respect to calculating the quantity-correction factor Wkor, as well as adapting the correction factors FWS1kor and FWS2kor in accordance with the above-mentioned first method, the following computational steps take place.

The extra fuel quantity is corrected using the factor Wkor by determining the missing quantity during the transition as the result of the integration of the lambda (λ) deviation. Wkor can be calculated directly from this missing quantity. The prerequisite for this is a linearized probe signal.

During the transition, the missing fuel quantity is added up. To adapt the transition compensation, two missing quantities must be defined:

The missing quantity during the initial phase of the transition:

$$Wfanf = \sum_{(Ta+Tt)\leqq kT\leqq Tc} (\lambda k - \lambda soll)^{*} tL_{k-m}$$

In this case, T is the time between 2 computational steps. As a result of the index displacement m, the idle time Tt between calculating the load tL and the lambda (λ) measurement, is considered. The index displacement is generally dependent upon load and speed.

$$m = tT/T$$

The required component of the fast memory is inferred from the missing quantity Wfanf.

The missing quantity during the entire transition:

$$Wfges = Wfanf + \sum_{Tc<kT\leqq Td} (\lambda k - \lambda soll)^{*} tL_{k-m}$$

Wfges is used to adapt the extra quantity as a function of the factor Wkor.

After recognition of load change and expiration of the idle time Tt, the summing operation is begun. In case one of the adaptation conditions is violated before reaching the instant Td, the summing operation is stopped, and the calculated sums are set to 0.

The wall-film quantity W (output variable of block 31 in FIG. 2) must be stored at the beginning (=Wa) and at the end of the load change (=We).

The correction factor Wkor can be determined directly from the missing quantity during the entire load change. A quotient is obtained from the required compensation quantity and the actual injected compensation quantity:

$$Wfkor=(W(t=Tb)-W(t=Ta)*Wfges)/(W(t=Tb)-W(t=Ta))$$

According to the direction of the load change, only one of the two factors is recalculated per learning operation.

It is not possible to directly calculate the factors FWS1kor and FWS2kor, since one does not calculate back to the lambda (λ) profile in the suction pipe. Therefore, the factors are adjusted incrementally based upon the missing quantity in the beginning phase of the transition Wfanf (integration of the missing quantity Wfanf):

with rising load (tLE<tLA): $FWS1kor_{neu}=FWS1kor_{alt}=TFWS * Wfanf$ with falling load (tLE<tLA): $FWS2kor_{neu}=FWS1kor_{alt}+TFWS * Wfanf$ The factor TFWS is established during the application. It determines the speed of the adaptation.

The flow diagram of FIG. 6 deals with the second method indicated above, that is estimating the missing quantity and incrementally calculating Wkor. Broad sections correspond thereby to the flow chart of FIG. 5. The storing of Td in block 67 is followed, however, by an addition of the missing quantity during the beginning phase, and the total amount of the missing quantity is determined through an estimation in 75. There is subsequently a check test of the adaptation release in 76, which continues for as long as the transition compensation is unequal to 0. This is established in block 77. The remainder corresponds to blocks 71 through 73 of FIG. 5. In particular, the missing quantity is estimated, Wkor is calculated incrementally, and the correction factors FWS1kor and FWS2kor are adapted as follows.

Contrary to the process 1) described above, in the case of the second method, the missing quantity is estimated during the transition using a simplified formula. To assure the convergency of the process, the factor Wkor is determined through integration as a function of the estimated missing quantity.

A linearized probe signal is required for this variant as well.

The missing quantity during the initial phase of the transition results from:

$$Wfanf=\frac{tLA+tLE}{2}*\sum_{(Ta+Tt)\leqq kT\leqq Tc}(\lambda_k-\lambda_{soll})$$

tLA and tLE are the load values at the beginning and the end of the transition (compare FIG. 4*a*).

The required component of the fast memory is inferred from the missing quantity Wfanf.

The missing quantity during the entire transition:

$$Wfges=Wfanf+tLE*\sum_{(Tc)\leqq kT\leqq Td}(\lambda_k-\lambda_{soll})$$

Wfges is used to adapt the missing quantity as a function of the factor Wkor.

After the load change is recognized and the idle time Tt has expired, the summing operation is begun. In case one of the mentioned conditions required for the adaptation is violated before the instant Td is reached, the summing operation is stopped, and the calculated sums are set to 0.

The correction factor Wkor is adjusted incrementally based upon the entire missing quantity Wfges (integration of the missing quantity Wfges). The integration is only carried out when the missing quantity is greater than a specified threshold, if $[Wfges]\geqq Wfges_{min}$ and tLA<tLE (rising load): $Wfkor_{neu}=Wfkor_{alt}+TW * Wfges$ if $[Wfges]\geqq Wfges_{min}$ and tLA>tLE (falling load): $Wfkor_{neu}=Wfkor_{alt}-TW * Wfges$ if $[Wfges]<Wfges_{min}$: $Wfkor_{neu}=Wfkor_{alt}$ The factor TW that is to be established during the application determines the speed of the adaptation.

The correction factors FWS1kor and FWS2kor are adapted as already described above. The integration is only carried out when the missing quantity Wfanf is greater than a specified threshold.

Figure 7:
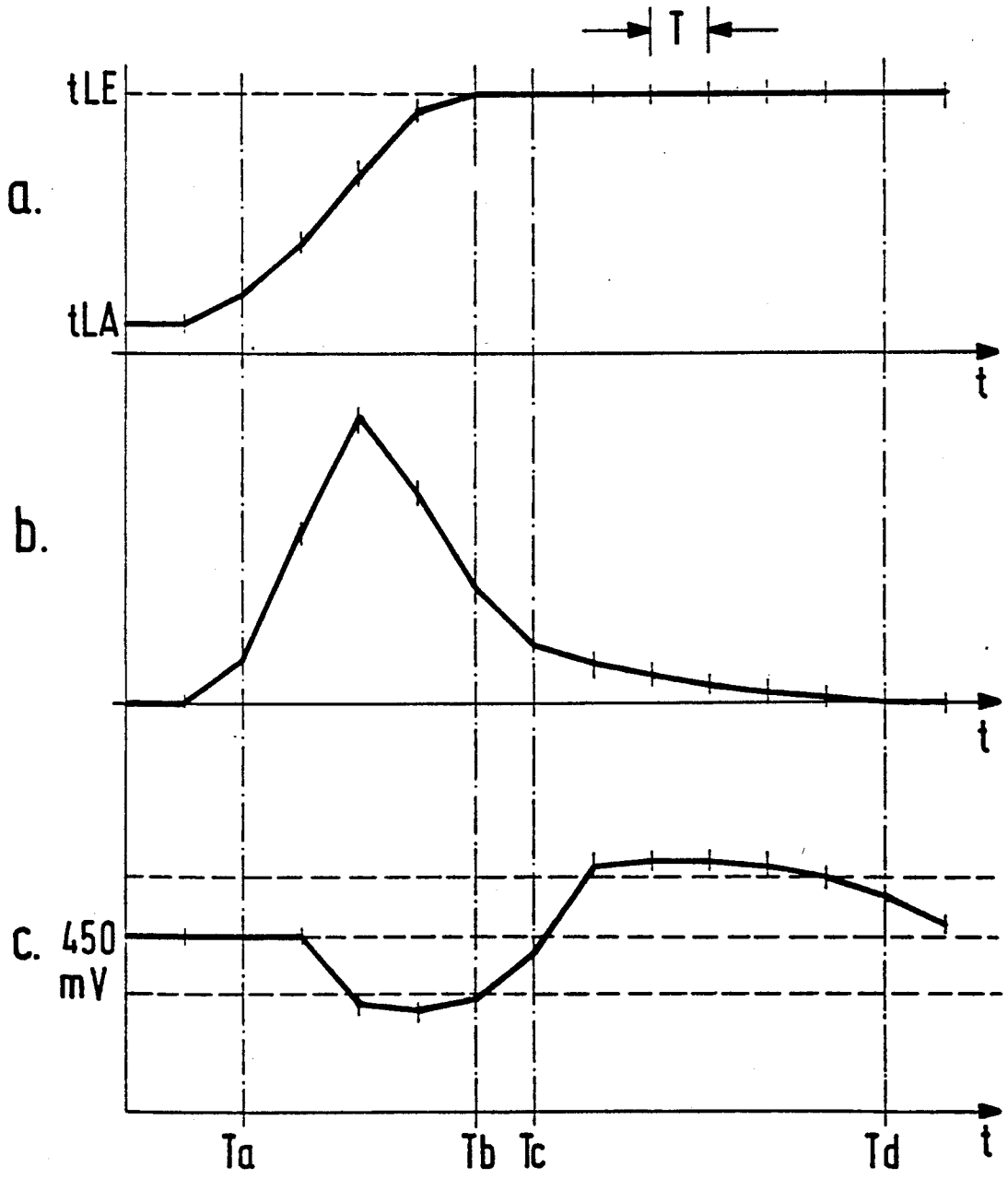
FIG. 7(*a–c*) shows the conditions corresponding to those of FIG. 3 when there is a non-linearized voltage at the exhaust-gas probe.
Figure 8:
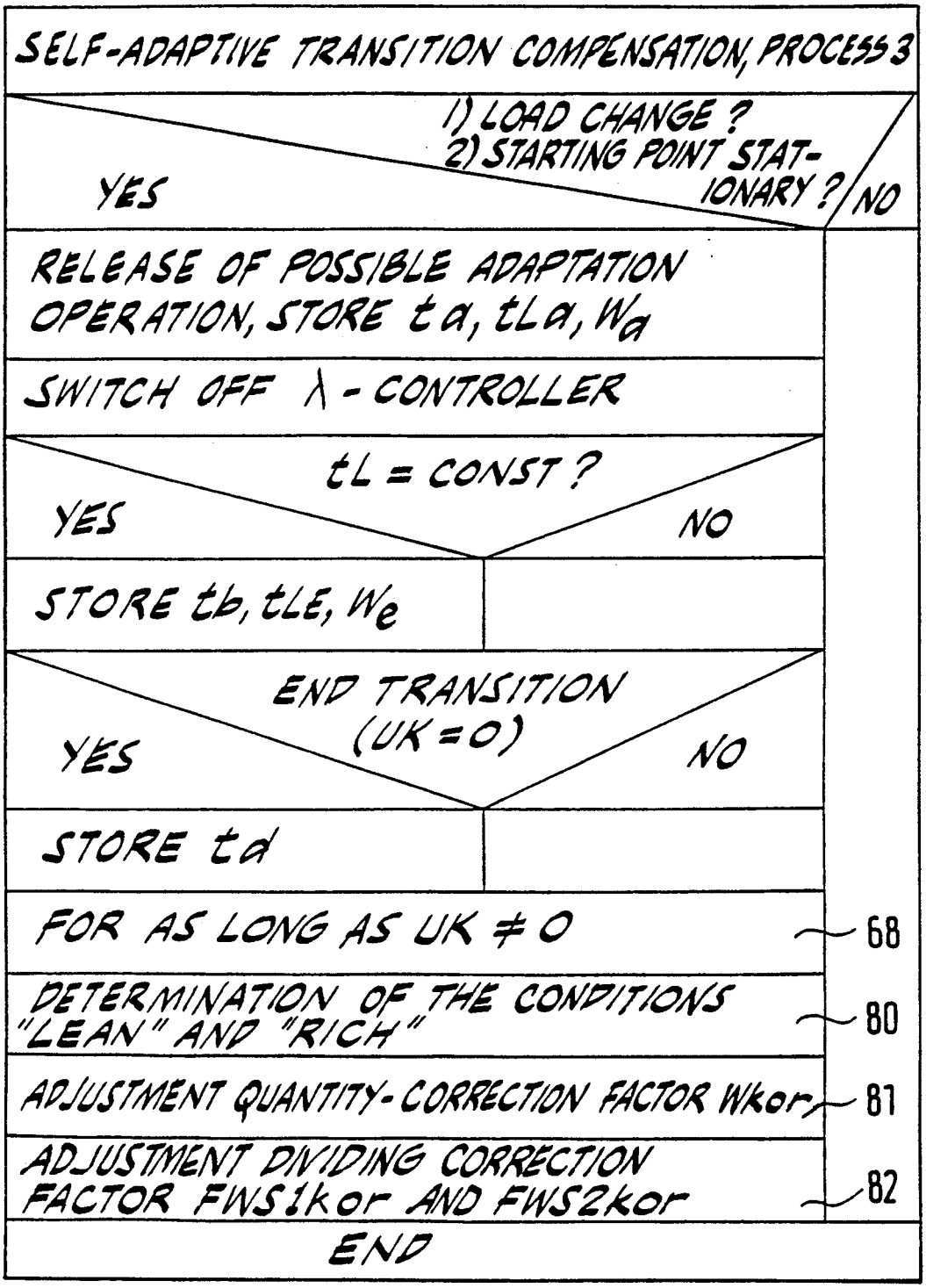
FIG. 8 shows a flow diagram for realizing the self-adaptive transition compensation by means of an incremental adjustment of the correction factors from the probe voltage with the application of a non-linearized probe voltage.

The third method, which incrementally adjusts the correction factors from the probe voltage, follows from the flow chart in FIG. 8 on the basis of a nonlinearized probe voltage, which is revealed in FIG. 7*c*. FIG. 7 corresponds, by the way, to FIG. 4.

The flow chart according to FIG. 8, likewise, corresponds to a great extent to the flow charts of FIGS. 5 and 6. In the diagram according to FIG. 8, however, the linearization of the probe voltage is dropped in accordance with block 63 of FIG. 5, since a non-linearized probe voltage is able to be processed according to the method of FIG. 8. The block 68 of a wait loop already known from FIG. 5, which lasts until the transition compensation equals 0 is followed in block 80 by a determination of the conditions "lean" and "rich." In 81, an adjustment of the quantity-correction factor Wkor follows, and finally in 82, an adjustment of the dividing factors FWS1kor and FWS2kor follows. In particular, the following operations proceed in connection with the incremental adjustment of the correction factors from the probe voltage:

Fast lean: All Uλ values in Ta . . . Tc are $<U_{rich}$ and at least one Uλ value in Ta . . . Tc is $<U_{lean}$ Fast rich: All Uλ values in Ta . . . Tc are $>U_{lean}$ and at least one Uλ value in Ta . . . Tc is $>U_{rich}$ Slow lean: All uλ values in Ta . . . Tc are $<U_{rich}$ and at least one Uλ value in Ta . . . Tc is $<U_{lean}$ Slow rich: All Uλ values in Ta . . . Tc are $>U_{lean}$ and at least one Uλ value in Ta . . . Tc is $>U_{rich}$ To adjust the quantity-correction factor Wkor, it applied that:

With a rising load (tLE>tLA);

| | | | | | | | |
|---|---|---|---|---|---|---|---|
| Fast lean | y | y | n | n | n | n | all other |
| Slow lean | y | n | y | n | n | n | cases |
| Fast rich | n | n | n | y | y | n | |
| Slow rich | n | n | n | y | n | y | |
| Increment Wfkor | x | x | x | — | — | — | — |

-continued

| | | | | | | | |
|---|---|---|---|---|---|---|---|
| Decrement Wfkor | — | — | — | x | x | x | — |

With a falling load (tLE<tLA):

| | | | | | | | |
|---|---|---|---|---|---|---|---|
| Fast lean | y | y | n | n | n | n | all other |
| Slow lean | y | n | y | n | n | n | cases |
| Fast rich | n | n | n | y | y | n | n |
| Slow rich | n | n | n | y | n | y | |
| Increment Wfkor | — | — | — | x | x | x | — |
| Decrement Wfkor | x | x | x | — | — | — | — |

The dividing correction factors FWS1kor and FWS2kor are adjusted in the following manner:

With rising load (tLE>tLA):

| | | | |
|---|---|---|---|
| Fast lean | y | n | all other |
| Slow lean | n | — | cases |
| Fast rich | n | y | |
| Slow rich | — | n | |
| Increment Wfkor | x | — | — |
| Decrement Wfkor | — | x | — |

With falling load (tLE>tLA):

| | | | |
|---|---|---|---|
| Fast lean | y | n | all other |
| Slow lean | n | — | cases |
| Fast rich | n | y | |
| Slow rich | — | n | |
| Increment Wfkor | — | x | — |
| Decrement Wfkor | x | — | — |

What is claimed is:

1. A system for controlling fuel injection for an internal-combustion engine when the engine is accelerating or decelerating, comprising:

(A) means for generating a basic injection-quantity signal (ti); and (B) means for generating a transition-compensation signal (UK) that connects to the means for generating the basic injection-quantity signal (ti), the means for generating the transition-compensation signal (UK) for adapting the basic fuel quantity (ti) when the engine is accelerating and decelerating, the means for generating the transition-compensation signal (UK) comprising, (1) means for storing engine characteristics maps of wall-film-quantity signal (W), and at least a first and second dividing factor (FWS1), FWS2) for acceleration and deceleration, respectively, (2) means for generating first correction signal (Wkor) for the wall-film-quantity signal (W), and for generating first and second correction factors (FWS1kor), FWS2kor) for first and second dividing factors (FWS1, FWS2), respectively, (3) means for combining the wall-film-quantity signal (W) and the first correction signal (Wkor), and for combining the first dividing factor (FWS1) with the first correction factor (FWS1kor) and the second dividing factor (FWS2) with the second correction factor (FWS2kor), the combining means further adapted to generate the transition-compensation signal (UK), and (4) means for adapting any of the first correction signal (Wkor), the first correction factor (FWS1kor) and the second correction factor (KWS2kor) for the values read out of the means for storing engine characteristics maps.

2. The system according to claim 1, wherein the means for generating the transition-compensation signal (UK) further includes means for generating a wall-film differential value (Δ W) from successive wall-film values (W), with the wall-film differential value (Δ W) being corrected by the first correction value (Wkor).

3. The system according to claim 1, wherein the transition-compensation signal (UK) is generated starting from the corrected wall-film differential value (Δ W) based upon corrected first and second dividing factors, which are corrected first and second Δ values (Ws, W1), respectively, that act at different rates.

4. The system according to claim 3, wherein the first correction value (Wkor) is adapted starting from a determination of an entire missing quantity during transition through an integration of a lambda (λ) deviation and of the subsequent calculation of the first connection value (Wkor).

5. The system to claim 3, wherein the first correction value (Wkor) is adapted through an integration as a function of an estimated missing quantity.

6. The system according to claim 3, wherein the first correction value (Wkor) and the first and second correction factors (FWS1kor, FWS2kor) are adapted through incremental adjustment based upon an oxygen-probe voltage.

* * * * *